US011607069B2

(12) United States Patent
Hudson

(10) Patent No.: US 11,607,069 B2
(45) Date of Patent: Mar. 21, 2023

(54) ASSEMBLY FOR DECORATING AT LEAST ONE WALL

(71) Applicant: Theodore A. Hudson, Lake Orion, MI (US)

(72) Inventor: Theodore A. Hudson, Lake Orion, MI (US)

( * ) Notice: Subject to any disclaimer, the term of this patent is extended or adjusted under 35 U.S.C. 154(b) by 94 days.

(21) Appl. No.: 17/180,484

(22) Filed: Feb. 19, 2021

(65) Prior Publication Data

US 2021/0251411 A1 Aug. 19, 2021

Related U.S. Application Data

(60) Provisional application No. 62/978,789, filed on Feb. 19, 2020.

(51) Int. Cl.
*A47G 33/06* (2006.01)
*A47G 33/12* (2006.01)

(52) U.S. Cl.
CPC ..... *A47G 33/06* (2013.01); *A47G 33/12* (2013.01); *A47G 2033/1266* (2013.01)

(58) Field of Classification Search
CPC ..... A47G 33/06; A47G 2033/1266
See application file for complete search history.

(56) References Cited

U.S. PATENT DOCUMENTS

| | | | | |
|---|---|---|---|---|
| 1,140,148 | A | 5/1915 | Furber | |
| 3,675,362 | A | 7/1972 | de Gelder | |
| 4,937,107 | A | 6/1990 | Mirisch, Sr. | |
| 4,989,355 | A | 2/1991 | Thomas | |
| 5,864,973 | A | 2/1999 | Cole | |
| 8,021,238 | B2 | 9/2011 | White | |
| 9,084,497 | B2 * | 7/2015 | Hawkins | A47F 5/114 |
| 2007/0235962 | A1 | 10/2007 | Jamie | |

FOREIGN PATENT DOCUMENTS

| | | | |
|---|---|---|---|
| CA | 2919283 | A1 | 7/2017 |
| CA | 2935832 | A1 | 7/2017 |

* cited by examiner

*Primary Examiner* — Adam Krupicka
(74) *Attorney, Agent, or Firm* — Simonelli IP, PLLC

(57) ABSTRACT

An ornamental tree assembly includes a base defining a presentation surface and at least one base edge defining a base periphery. A lower portion of an ornamental tree is fixedly secured to the presentation surface of the base. A plurality of walls is movable with respect to the base, with at least one of the walls pivotally secured to the base edge. The ornamental tree assembly also includes an upper portion of the ornamental tree fixedly secured to another of the plurality of walls. The upper portion of the ornamental tree is inverted and disposed adjacent the lower portion of the ornamental tree when the plurality of walls are configured in a storage configuration; and the upper portion is upright and extending over the lower portion when the plurality of storage walls are in a display configuration.

11 Claims, 5 Drawing Sheets

ASSEMBLY FOR DECORATING AT LEAST ONE WALL

This patent application claims priority to a United States provisional patent application filed on Feb. 19, 2020 and having application Ser. No. 62/978,789.

BACKGROUND OF THE INVENTION

1. Field of the Invention

The invention relates to ornamental assemblies. More particularly, the invention relates to ornamental assemblies that are convertible between a stored configuration and a display configuration.

2. Description of the Related Art

Temporary/seasonal ornamentation of a room or house is time consuming and difficult to perform. This is especially true with large items, such as Christmas trees, which can be awkward to position and get back into storage. There is a need to reduce the effort needed to decorate and undecorate a room.

The natural Christmas tree, the artificial Christmas tree, and even the half or quarter artificial Christmas tree is the most commonly seen on the market. All of the fore mentioned products present problematic attributes. A natural Christmas tree is generally very expensive and inconvenient to acquire, transport and maintain. It's also very time consuming to install & decorate, not to mention its very large footprint taking up valuable floor space in a home. The artificial tree presents some of the same problems, being very time consuming to assemble and decorate, and again taking up way too much space. Next, we have the half or quarter artificial "space saving" trees. While they do save space, it takes as long to assemble, and unless you are standing directly in front of the tree it is very apparent that the tree is not whole and looks rather unpleasing to the eye. Additionally, the traditional tree toppers rarely get sufficient support in a free-standing tree.

SUMMARY OF THE INVENTION

An ornamental tree assembly includes a base defining a presentation surface and at least one base edge defining a base periphery. A lower portion of an ornamental tree is fixedly secured to the presentation surface of the base. A plurality of walls are disposed adjacent the base, with at least one of the plurality of walls secured to the at least one base edge. The ornamental tree assembly also includes an upper portion of the ornamental tree fixedly secured to another of the plurality of walls. The upper portion of the ornamental tree is inverted and disposed adjacent the lower portion of the ornamental tree when the plurality of walls are configured in a storage configuration; and the upper portion is upright and extending over the lower portion when the plurality of storage walls are in a display configuration.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE INVENTION

Referring to FIG. 1A through 2D, one embodiment of the ornamental tree assembly is generally indicated at 10. The ornamental tree assembly 10 is shown in the storage configuration in FIG. 1A. Conversely, the ornamental tree assembly 10 is shown in display configuration in FIG. 1B. In storage configuration, the ornamental tree assembly 10 is rectangular in shape with a plurality of walls 12 extending about the ornamental tree assembly 10. In storage configuration, the ornamental tree assembly 10 rests on a base, generally shown at 14, best seen in FIG. 1B.

Figure 1A:
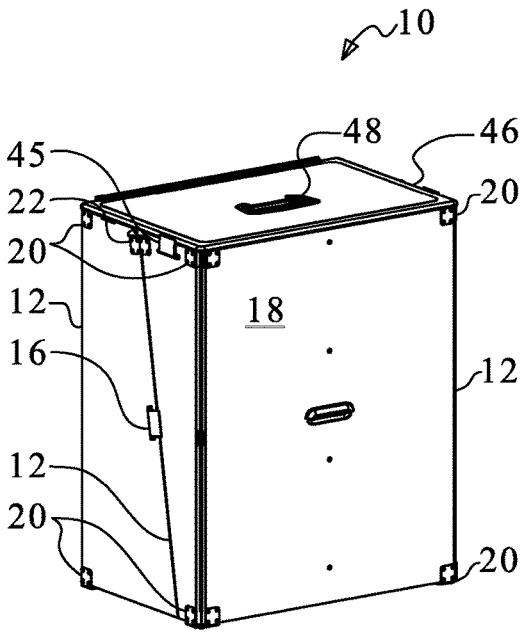
FIG. 1A is a perspective view of a first embodiment of an ornamental tree assembly in a storage configuration.
Figure 1B:
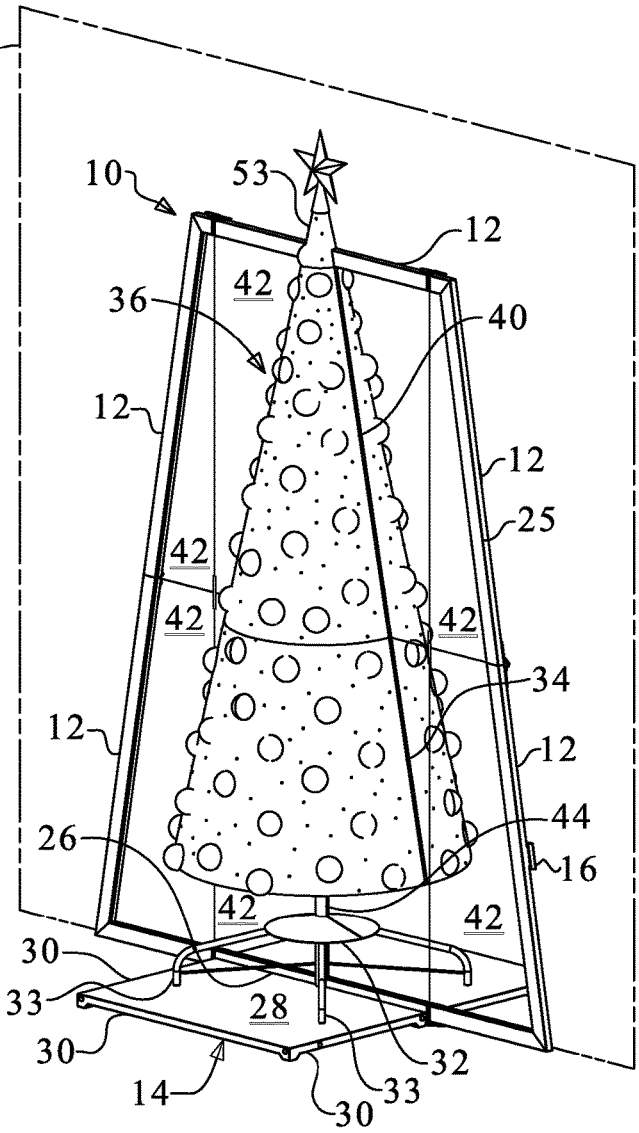
FIG. 1B is a perspective view of the first embodiment of the ornamental tree assembly in a display configuration.

A first set of latches 16 are used to disconnect and reconnect the plurality of walls 12 allowing the ornamental tree assembly 10 to convert between the storage (FIG. 1A) and display configurations (FIG. 1B). Further, a first set of hinges 20 hold adjacent walls 12 in positions and allowing those adjacent walls 12 to pivot with respect to each other 90°. A second set of hinges 22 allow adjacent walls 12 to pivot with respect to each other 180°.

In the display configuration, the plurality of walls 12 are moved with respect to each other such that they end up defining a single plane 24. In other words, the plurality of walls 12 are unfolded about the base 14 to form a wall 25 that defines the single plane 24. The single wall 25 remains secured to the base 14. The single wall 25 extends out from the base 14 perpendicularly thereto. More specifically, at least one of the plurality of walls 12 is fixedly secured to the base 14 along at least one base edge 26 of a set of base edges 26, 30 that define a base periphery. The other of the plurality of walls 12 are pivoted about the at least one of the plurality of walls 24 and the base 14 to create the single wall 25 in the single plane 24. A top surface 28 of the base 14 is a presentation surface.

A tree base 32 is fixedly secured to the presentation surface 28 of the base 14. In the embodiment shown, the tree base 32 includes a plurality of legs 33. A lower portion 34 of an ornamental tree, generally shown at 36, is fixedly secured to the tree base 32. The lower portion 34 may also be fixedly secured to one of the plurality of walls 12 that extends up along the side of the lower portion 34 of the ornamental tree 36.

An upper portion 40 of the ornamental tree 36 is fixedly secured to another 18 of the plurality of walls 12. The upper portion 40 is designed such that, when in the display configuration, the upper portion 40 extends directly over the lower portion 34 to create the appearance of the unitary ornamental tree 36.

In the embodiment shown in FIGS. 1A and 1B, the ornamental tree 36 extends through a hemisphere. More specifically, only half of the ornamental tree 36 exists. Each of the plurality of walls 12 defines an interior surface 42 that is treated in some manner to be reflective. As such, the appearance of the ornamental tree 36 disposed immediately adjacent the plurality of walls 12 in the display configuration gives the appearance of a complete tree extending about its trunk 44. In the Figures, the ornamental tree 36 is shown to be permanently decorated with ornaments, so as to maximize the ease in setting up the ornamental tree assembly 10. It should, however, be appreciated by those skilled in the art that the ornamental tree 36 could be stored and assembled without ornaments, only to manually decorate the ornamental tree 36 as desired.

Figure 2A:
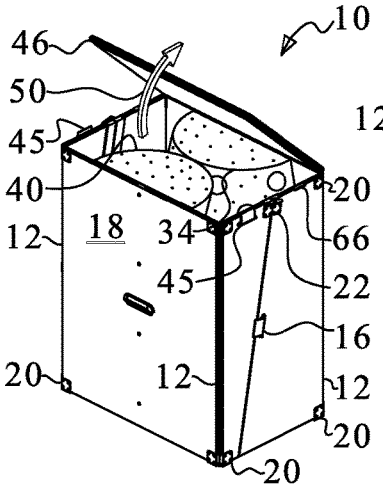
FIGS. 2A through 2D are perspective views of the first embodiment of the ornamental tree assembly being as it transitions from the storage configuration to the display configuration.
Figure 2B:
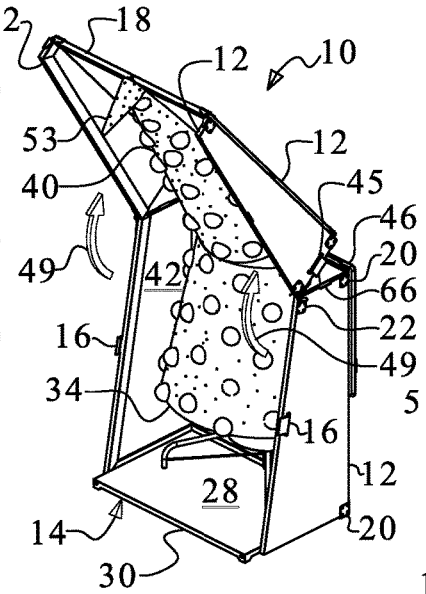

As stated above, the ornamental tree assembly 10 is in its storage configuration in FIG. 1A. Turning attention to FIGS. 2A through 2D, the ornamental tree assembly 10 is shown in sequence as it is converted from its storage configuration into its display configuration. In FIG. 2A, a second set of latches 45 release a lid 46 with a handle 48, allowing the lid 46 to pivot about one of the plurality of walls 12 in the direction of arrow 50. When in the display configuration, the lid 46 rests along the backside of one of the plurality of walls 12 out of view. Once the lid 46 is out of the way, the first set of latches 16 relating to the plurality of walls 12 associated with the upper portion 40 of the ornamental tree 36 are unlatched. The second set of hinges 22 allow for the upper portion 40 of the ornamental tree 36 and the another 18 of the plurality of walls 12 to pivot 180° in the direction of arrows 49, such that the upper portion 40 extends over the lower portion 34 in a manner such that the trunk 44 of the ornamental tree 36 extends through the lower 34 and upper 40 portions of the ornamental tree in a coaxial manner. In other words, the trunk 44 is in line with itself from the tree base 32 up through the top of the upper portion 40 of the ornamental tree 36.

Figure 2C:
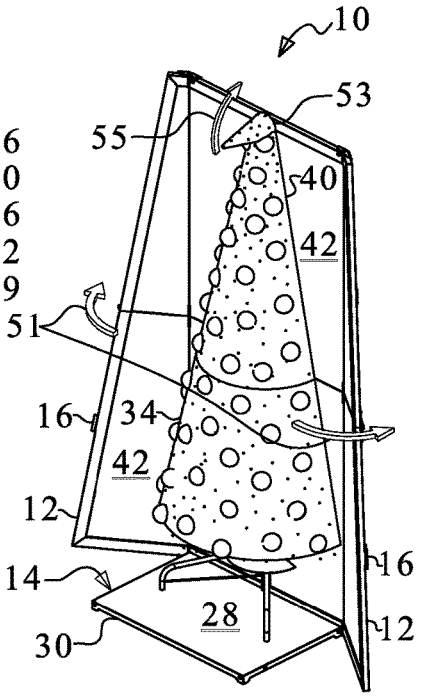
Figure 2D:
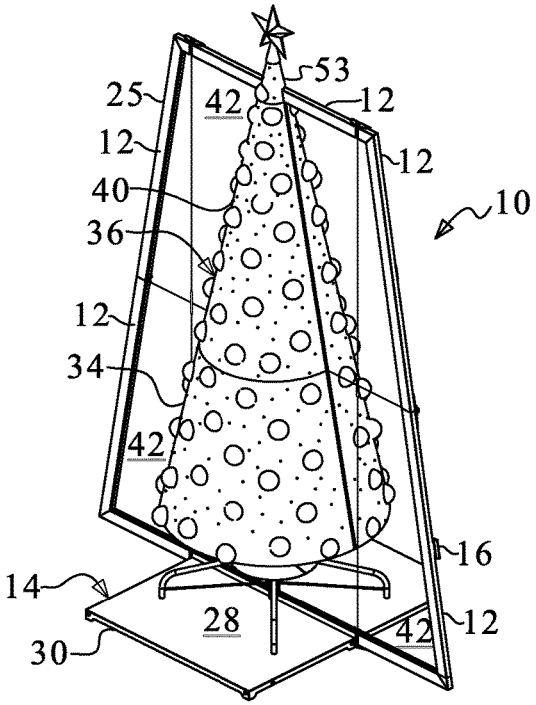

Referring to FIG. 2C, once the upper portion 40 of the ornamental tree 36 is in place, the plurality of walls 12 associated with the upper portion 40 are then latched again to the plurality of walls 12 associated with the lower portion 34 of the ornamental tree 36. The plurality of walls 12 that are now furthest from the ornamental tree 36 are then pivoted in the direction of arrows 51 about the first set of hinges 20 to complete the creation of the single plane wall 24. A top portion 53 of the ornamental tree 36 is then pivoted in the direction of arrow 55 into alignment with the rest of the ornamental tree 36, as is shown in FIG. 2D.

Figure 3A:
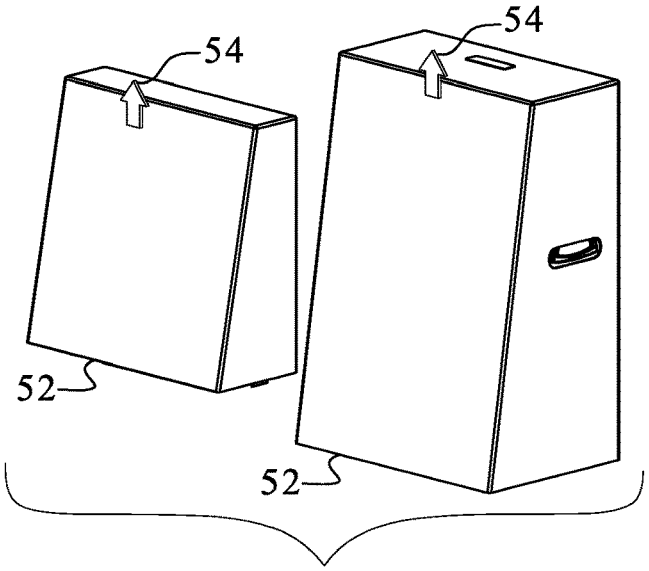
FIGS. 3A through 3C are perspective views of a third embodiment of the ornamental tree assembly transitioning from a storage configuration to an open configuration.
Figure 3B:
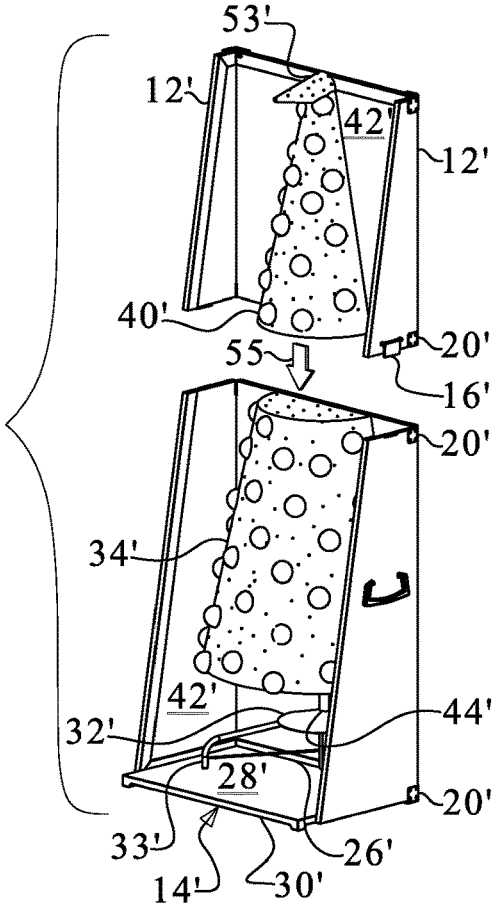
Figure 3C:
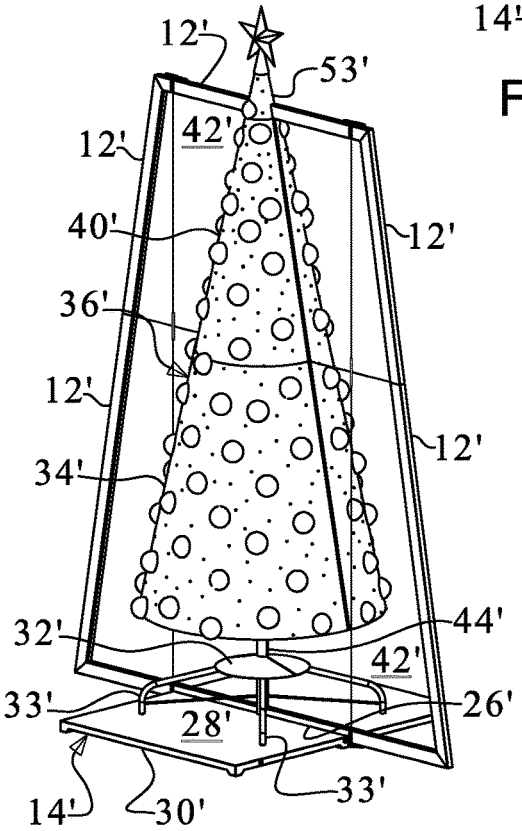

Referring to FIGS. 3A through 3C, a first alternative embodiment is shown wherein like prime reference numerals represent similar elements as those shown in FIGS. 1A through 1C. In this embodiment, the upper portion 40' of the ornamental tree 36' is stored in a separate structure. The separate structures are stored with covers 52. In one embodiment, the covers 52 are fabric. In another embodiment (not shown), the covers 52 include structural supports to assist in maintaining the general shape of the structures they cover. The covers 52 are lifted up and away from the ornamental tree assembly 10' in the direction of arrows 54. The upper portion 40' is lifted up and then lowered in the direction of arrows 55 onto the lower portion 36' of the ornamental tree assembly 10'. From this point, the plurality of walls 12' are pivoted open to create the single wall 25' in the single plane (not shown in these Figures).

Figure 4A:
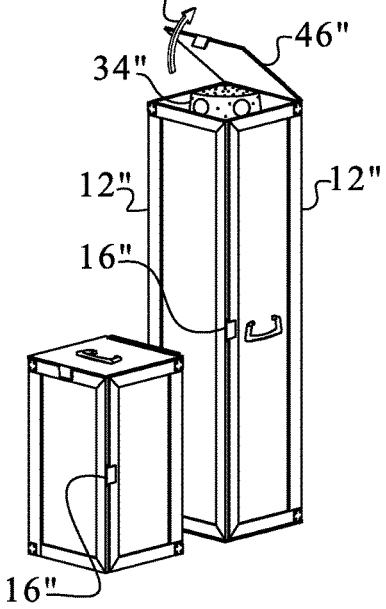
FIGS. 4A through 4C are perspective views of a fourth embodiment of the ornamental tree assembly transitioning from a storage configuration to an open configuration.
Figure 4B:
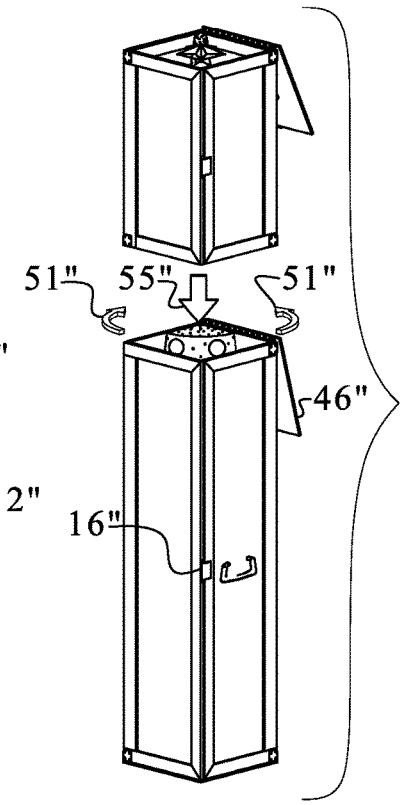
Figure 4C:
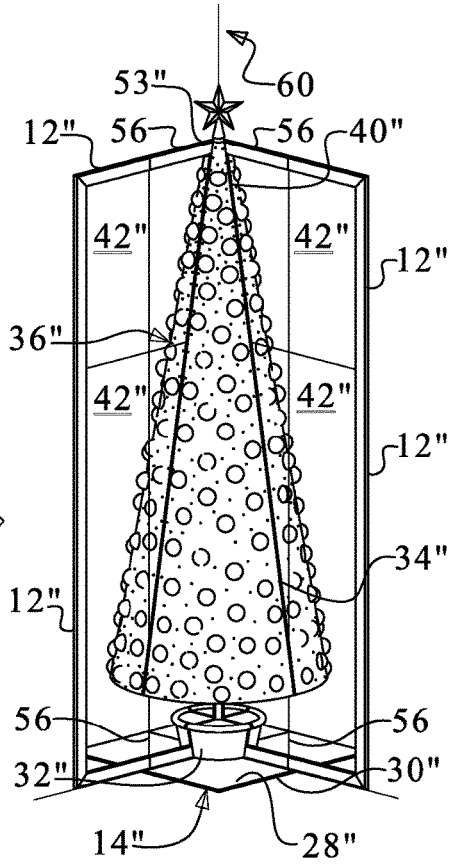

Referring to FIGS. 4A through 4C, a third alternative embodiment is shown, wherein like double-prime reference numerals represent similar elements as those shown in the embodiments described above. In this embodiment, the upper portion 40" of the ornamental tree 36" is again stacked upon the lower portion 34" of the ornamental tree 36". This embodiment differs from all of the other embodiments in that only a quarter of the ornamental tree 36" exists. This ornamental tree assembly 10" is designed to be displayed in a corner 60 of a room. As such, two 56 of the plurality of side walls 12" are fixedly secured to each other at 90° with respect to each other and with respect to the base 14".

Figure 5A:
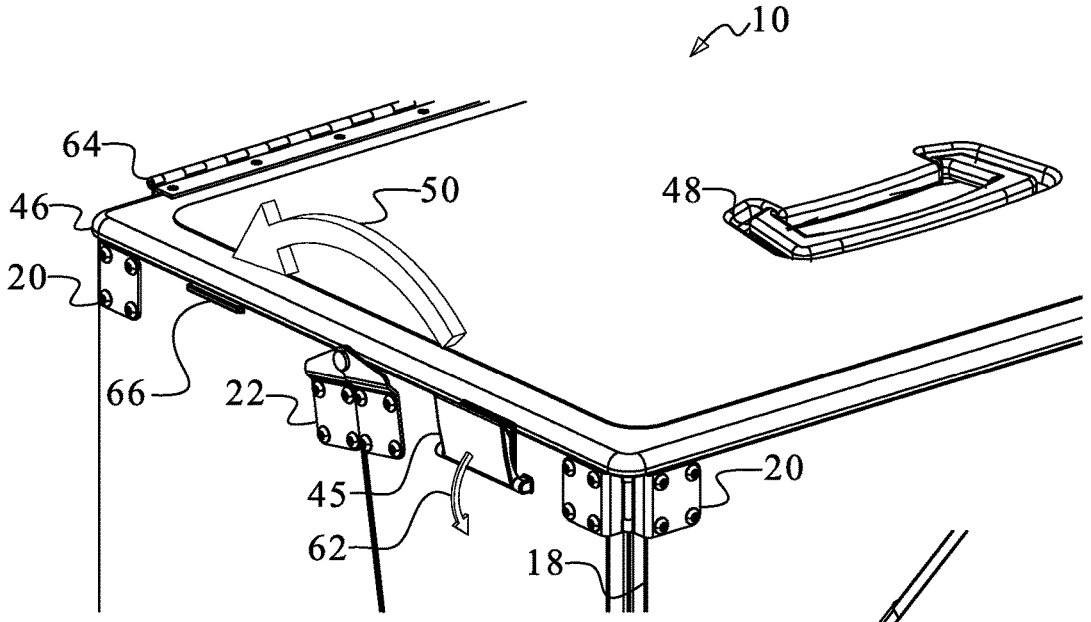
FIGS. 5A through 5C are perspective views, partially cut away, of close-ups of a portion of the first embodiment of the invention to illustrate operation of one of the latches.
Figure 5B:
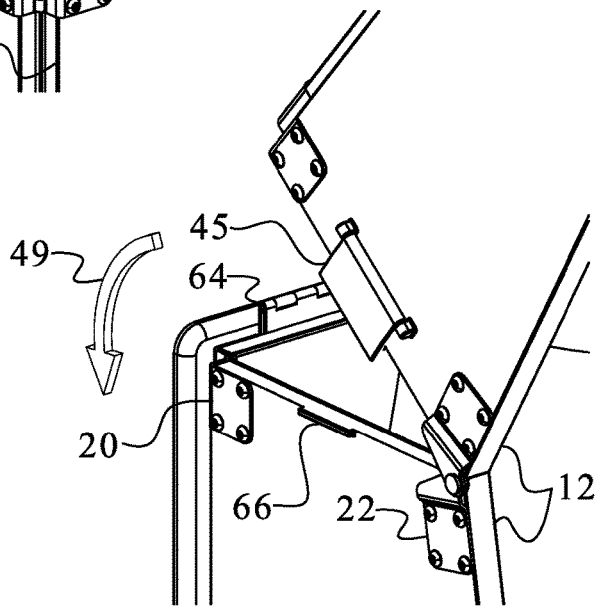
Figure 5C:
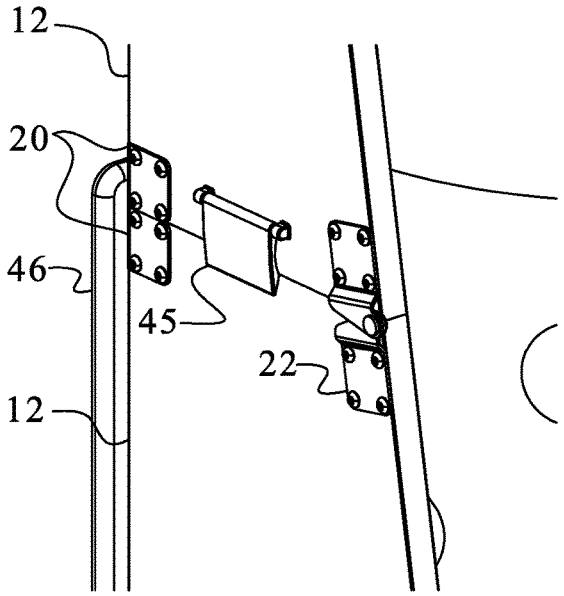

Turning attention to FIGS. 5A through 5C, the operation of the second set of latches 45 is shown. In FIG. 5A, the second set of latches 45 (only one shown) is pulled in the direction of arrow 62. This releases the lid 46 to move in the direction of the arrow 50 about a lid hinge 64. Once the lid 46 is moved out of the way, the portion of the plurality of walls 12, 18 that are associated with the upper portion 40 are pivoted about the hinges 22. Once the upper portion 40 of the ornamental tree 36 is positioned over the lower portion 34 of the ornamental tree 36, the second set of latches 45 engage a male lip 66. After the second set of latches 45 lock with the male lips 66, the plurality of walls 12 can be pivoted about the first set of hinges 20 to create the single wall 25.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

I claim:

1. An ornamental tree assembly comprising:

a base defining a presentation surface and at least one base edge defining a base periphery;

a lower portion of an ornamental tree fixedly secured to said presentation surface of said base;

a plurality of walls disposed adjacent said base, with at least one of said plurality of walls secured to said at least one base edge; and an upper portion of said ornamental tree fixedly secured to another of said plurality of walls, such that said upper portion of said ornamental tree is inverted and disposed adjacent the lower portion of said ornamental tree when said plurality of walls are in a storage configuration, and said upper portion is upright and extending over said lower portion when said plurality of walls is in a display configuration.

2. An ornamental tree assembly as set forth in claim 1 wherein each of said plurality of walls is pivotally secured to at least another of said plurality of walls.

3. An ornamental tree assembly as set forth in claim 2 wherein said at least one of said plurality of walls is fixedly secured to said base edge preventing lost motion between said base and said at least one of said plurality of side walls.

4. An ornamental tree assembly as set forth in claim 1 including a lid to enclose said ornamental tree assembly when said ornamental tree assembly is in the storage configuration.

5. An ornamental tree assembly comprising:

a base defining a presentation surface and at least one base edge;

a lower portion of an ornamental tree fixedly secured to said presentation surface of said base;

a plurality of walls with at least one of said plurality of walls secured to said at least one base edge, each of said plurality of walls defining an interior reflective surface;

at least one hinge disposed between two of said plurality of walls allowing one of said plurality of walls to pivot with respect to the other of said plurality of walls; and an upper portion of said ornamental tree secured to another of said plurality of walls such that said upper portion of said ornamental tree is stackable onto said lower portion of said ornamental tree and said another of said plurality of walls sit atop and are removable securable to at least one of said plurality of walls, wherein said upper and lower portions of said ornamental tree are reflected in said plurality of walls when said plurality of walls are pivoted with respect to each other into an open configuration.

6. An ornamental tree assembly as set forth in claim 5 wherein each of said plurality of walls is pivotally secured to at least another of said plurality of walls.

7. An ornamental tree assembly as set forth in claim 6 wherein said at least one of said plurality of walls is fixedly secured to said base edge preventing lost motion between said base and said at least one of said plurality of side walls.

8. An ornamental tree assembly as set forth in claim 6 wherein said at least two of said plurality of walls is fixedly secured to said base edge preventing lost motion between said base and said at least two of said plurality of side walls.

9. An ornamental tree assembly as set forth in claim 8 wherein said at least two of said plurality of walls are fixedly secured to each other.

10. An ornamental tree assembly as set forth in claim 9 wherein said at least two of said plurality of walls are oriented ninety degrees with respect to each other.

11. An ornamental tree assembly as set forth in claim 10 wherein said another of said plurality of walls is removably securable to one of said plurality of walls secured to said base.

* * * * *